US008113219B1

(12) United States Patent
Chang

(10) Patent No.: US 8,113,219 B1
(45) Date of Patent: Feb. 14, 2012

(54) COSMETIC POWDER DISPENSER WITH RETRACTABLE BRUSH

(76) Inventor: Charles Chang, Wayne, NJ (US)

( * ) Notice: Subject to any disclaimer, the term of this patent is extended or adjusted under 35 U.S.C. 154(b) by 543 days.

(21) Appl. No.: 12/316,765

(22) Filed: Dec. 16, 2008

Related U.S. Application Data

(60) Provisional application No. 61/200,511, filed on Dec. 1, 2008.

(51) Int. Cl.
*A45D 33/02* (2006.01)

(52) U.S. Cl. ..... 132/299; 132/298

(58) Field of Classification Search ..... 132/306, 132/307, 305, 317, 318, 313, 314, 315, 300, 132/298, 293–295; 401/123, 131; 206/229, 206/581, 235; 220/259
See application file for complete search history.

(56) References Cited

U.S. PATENT DOCUMENTS 1,588,633 A * 6/1926 Taylor ..... 401/99
1,670,315 A * 5/1928 Reutter ..... 132/305
2,001,691 A * 5/1935 Reilly ..... 132/307
2,120,849 A * 6/1938 Almonte ..... 132/307
4,671,690 A * 6/1987 Ladd et al. ..... 401/123
5,515,875 A * 5/1996 Acker et al. ..... 132/298
6,053,183 A * 4/2000 Rizzo ..... 132/307

* cited by examiner

*Primary Examiner* — Robyn Doan

(74) *Attorney, Agent, or Firm* — K. Gibner Lehmann

(57) ABSTRACT

A dispenser for storing and applying a supply of cosmetic powder, includes a container and closure cap. The closure cap carries an applicator brush that is manually advanceable or retractable with respect to the closure cap. The mouth of the container is covered by an apertured transverse wall and a lid thereon, the lid normally blocking communication between the powder in the container and the brush. When the closure cap is removed, the lid can be manually lifted by means of a hinged connection, to as to expose a small accumulation of powder that has adhered to the transverse wall. The applicator brush is then advanced, and used in the manner of a dabber to pick up particles of the powder and apply them to the user. Simplified components and assembly characterize the completed unit.

9 Claims, 10 Drawing Sheets

COSMETIC POWDER DISPENSER WITH RETRACTABLE BRUSH

CROSS REFERENCES TO RELATED APPLICATIONS

The present application claims the benefit of my/our U.S. Provisional Application No. 61/200,511 filed Dec. 1, 2008, and entitled COSMETIC POWDER DISPENSER WITH RETRACTABLE BRUSH, and the subject matter thereof is specifically incorporated herein by specific reference thereto.

STATEMENT AS TO RIGHTS TO INVENTIONS MADE UNDER FEDERALLY SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates generally to cosmetic products, and more particularly to cosmetic powder dispensers of the type utilizing an applicator brush that is carried in a removable cover or cap, along with a powder reservoir to which the cap is selectively attached.

2. Description of the Related Art Including Information Disclosed Under 37 CFR 1.97-1.99

The following references are hereinbelow listed as being considered a representative sampling of prior art in the field to which the present invention pertains:

U.S. Pat. Nos. 2,480,331
4,626,119
4,974,981

U.S. Patent Applications Publications Nos.: 2002/0141807
2006/0130869
2008/0060674

U.S. Pat. No. 2,480,331 shows a cosmetic dispenser utilizing a slide/slot arrangement for advancing a brush carried in a body member. In the embodiment of FIG. 2, there is a container for storing a quantity of the material to be dispensed, receivable on a base that contains an upwardly facing brush. A shutter mechanism accessible via an outwardly extending projection (16), permits the user to vary the amount of powder flowing, by gravity, from the container onto the bristles of the brush. The latter can be advanced with respect to its base, by means of the slide/slot arrangement shown in FIG. 3.

U.S. Pat. No. 4,626,119 discloses a powder applicator having a retractable brush. Column 3, lines 1-15 summarize the operation. A brush (36) with bristles (38) having tips (40) is slidably disposed in the open end of a member (34). The member has two oppositely disposed longitudinally extending slots (42), only one of which is shown, and a pair of runners (44) slidable therein. The brush can be slid outwardly from the member (34) to a first, forward position at which the bristles extend outwardly from the member, and can also be retracted into a second, withdrawn position at which only the tips are exposed. The positions of the slots and runners are such that the brush is always secured to the member and the member can thus act as a brush handle.

U.S. Pat. No. 4,974,981 illustrates yet another construction for an applicator employing a retractable brush. In FIG. 3 of the patent, there is shown an upper container for storing a quantity of cosmetic powder, and a lower cylinder member in which there is slidably carried an applicator brush. Disposed at the bottom of the container is a small aperture for controlling the flow, by gravity, of powder from the upper container downwardly to the brush bristles. The upper container has a deformable wall which can be depressed in order momentarily pressurize the interior and commence a 'spray' of the powder through the aperture, as shown in FIG. 3.

Publication No. 2002/0141807 also discloses a cosmetic powder dispenser employing a retractable brush construction having a brush holder (50) for brush bristles (53). A mechanism (not shown) is suggested for advancing and retracting the bristles from the holder (50), as noted in paragraph [0034] of the document. Control of powder flow is accomplished by a scoop refill mechanism described in paragraphs [0020] to [0024] of the patent.

Publication 2006/0130869 relates to a retractable brush carried in a first compartment, and a second compartment containing multiple small holes for restricting passage of loose cosmetic powder from a third compartment, which latter constitutes a storage container therefor. The consumer controls the flow of powder by rotating one section of the brush-carrying compartment with respect to another section thereof, in the manner of opening a lipstick casing, i.e. by means of a twisting action. Reference is made to paragraph [0018] of the publication.

Finally publication No. 2008/0060674 involves a retractable brush structure, wherein the retraction is accomplished by turning a first part of a closure cap with respect to a second, stationary part of the same cap. The arrangement is briefly explained in the Abstract portion of this document.

It is considered that large scale commercialization of the devices noted above has not occurred. Undue complexity may have been a concern. Alternately, promotional considerations may have prevented the disclosed arrangements from being made and sold in significant quantities.

Accordingly, the relatively high demand today, for treatments to the face, hands, and body, has resulted in the need for large-scale, inexpensive yet reliable methods and fixtures for storing and dispensing skin and beauty-care products.

SUMMARY

At least some disadvantages of prior cosmetic and like dispensers are largely overcome by the present invention, which is believed to have at least some of the following objects: 1) the provision of a novel and improved cosmetic dispenser which is especially simple in its structure, and which provides especially rapid access to cosmetic material contained therein.

2) to provide an improved cosmetic dispenser as above characterized, that can be readily stored in a pocketbook or purse, and thereafter readied for use by the consumer, with a minimum of effort.

3) to provide an improved cosmetic dispenser of the type noted above, wherein there are virtually eliminated problems with spillage of product, thus making use of the dispenser especially neat and tidy.

4) to provide an improved cosmetic dispenser of the kind indicated, which can be readily molded in simple mold cavities, and assembled with a minimum of time and with no special equipment being required.

An important feature of the invention is that of enabling a mostly-assembled dispenser to be filled with powder as a last step, followed by installation of a simple closure plug. By such an arrangement there is minimized undesirable powder spillage during the assembly of the components of the dispenser.

The objects are accomplished, in a main embodiment, by a cosmetic dispenser comprising a unique combination of a container for storage of a quantity of cosmetic powder, the container having a mouth, and wherein the dispenser further has a closure cap mounted on the mouth. The closure cap carries an applicator brush that is capable of advancing and retracting movement, by the user. Flow-regulating means comprising an apertured transverse wall, is carried by the container and extends across the mouth thereof. The flow-regulating means comprises a cover hingedly connected to the apertured transverse wall and overlying the same to normally isolate the applicator brush from the container and the powder disposed therein when the closure cap is received on the mouth of the container. The transverse wall and the cover are rendered accessible solely when the closure cap is removed from the container. The cover further is pivotally connected with the transverse wall and capable of being manually shifted from a first, closed position overyling the transverse wall to a second, open position exposing the transverse wall, by means of said hinged connection. The arrangement is such that in the second, open position, the powder contents on the transverse wall are accessible to be picked up by the advanced applicator brush.

Other features and advantages will hereinafter appear.

BRIEF DESCRIPTION OF THE DRAWINGS

In the drawings, illustrating a preferred embodiment of the invention.

DESCRIPTION OF THE PREFERRED EMBODIMENT AND INVENTOR'S BEST MODE OF CARRYING OUT THE INVENTION

Figure 1:
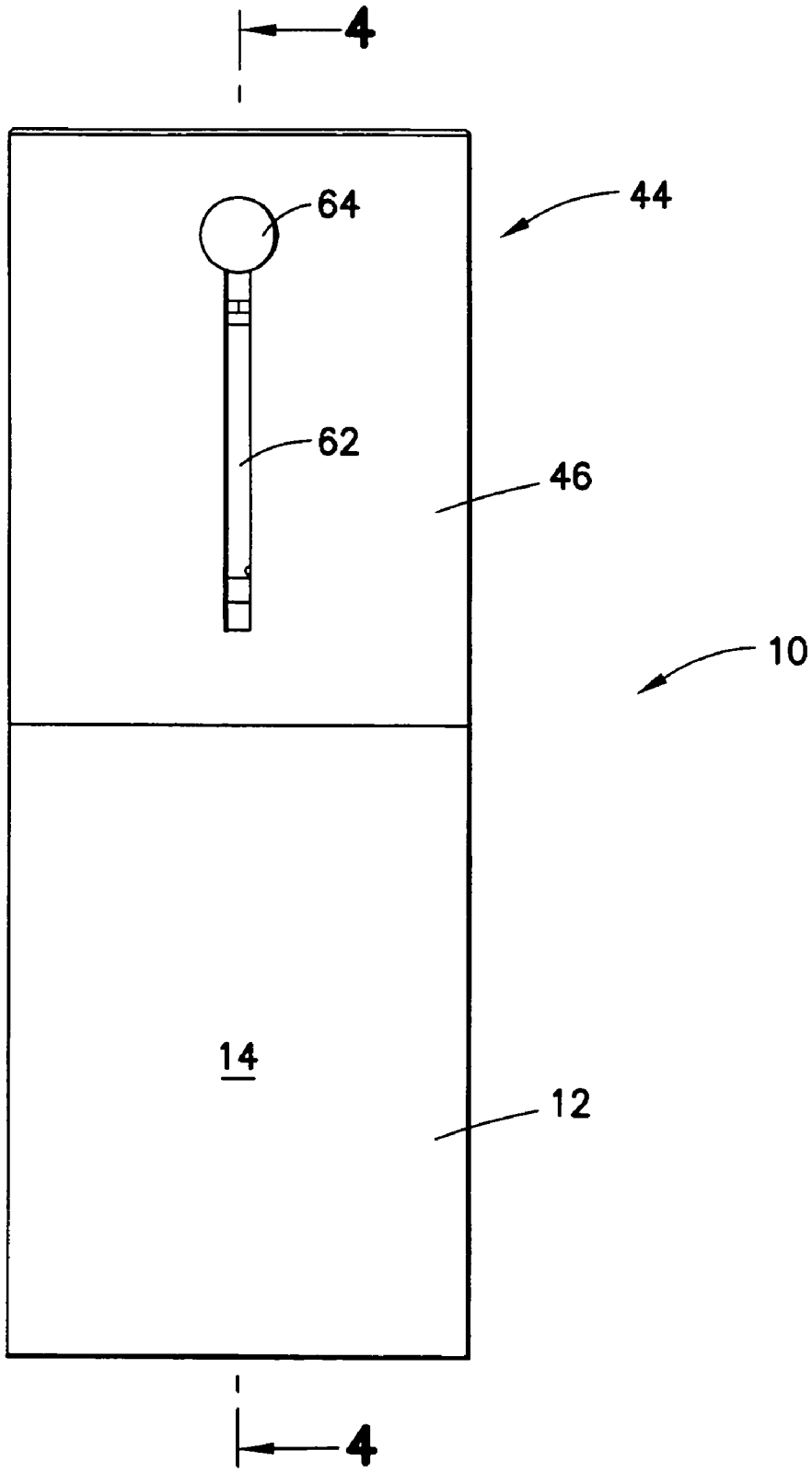
FIG. 1 is a front elevation of the cosmetic dispenser of the invention.
Figure 2:
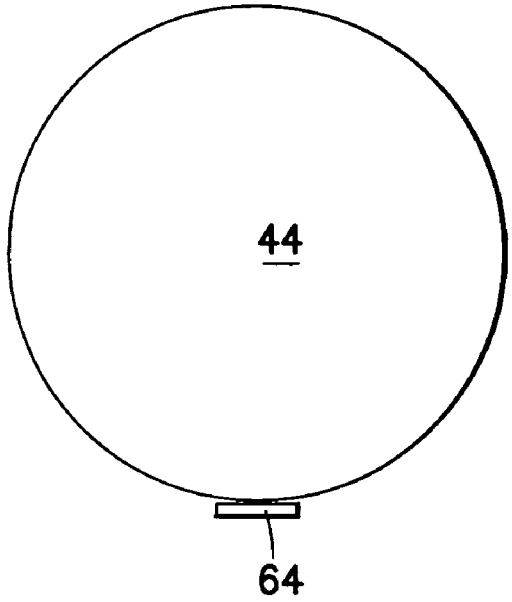
FIG. 2 is a top plan view of the dispenser of FIG. 1.
Figure 3:
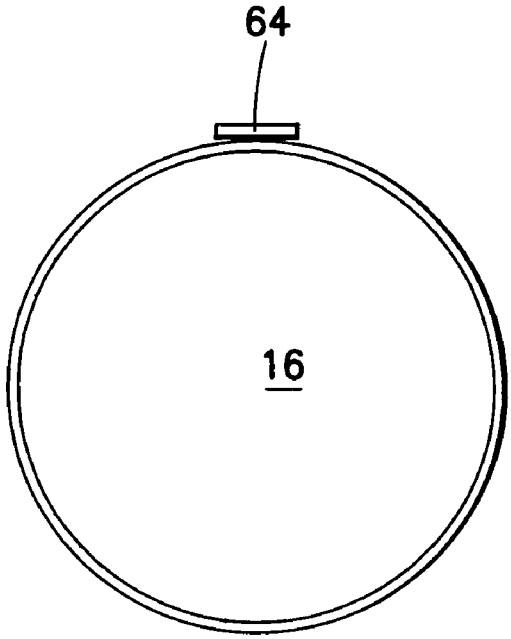
FIG. 3 is a bottom plan view of the dispenser of FIGS. 1 and 2.
Figure 4:
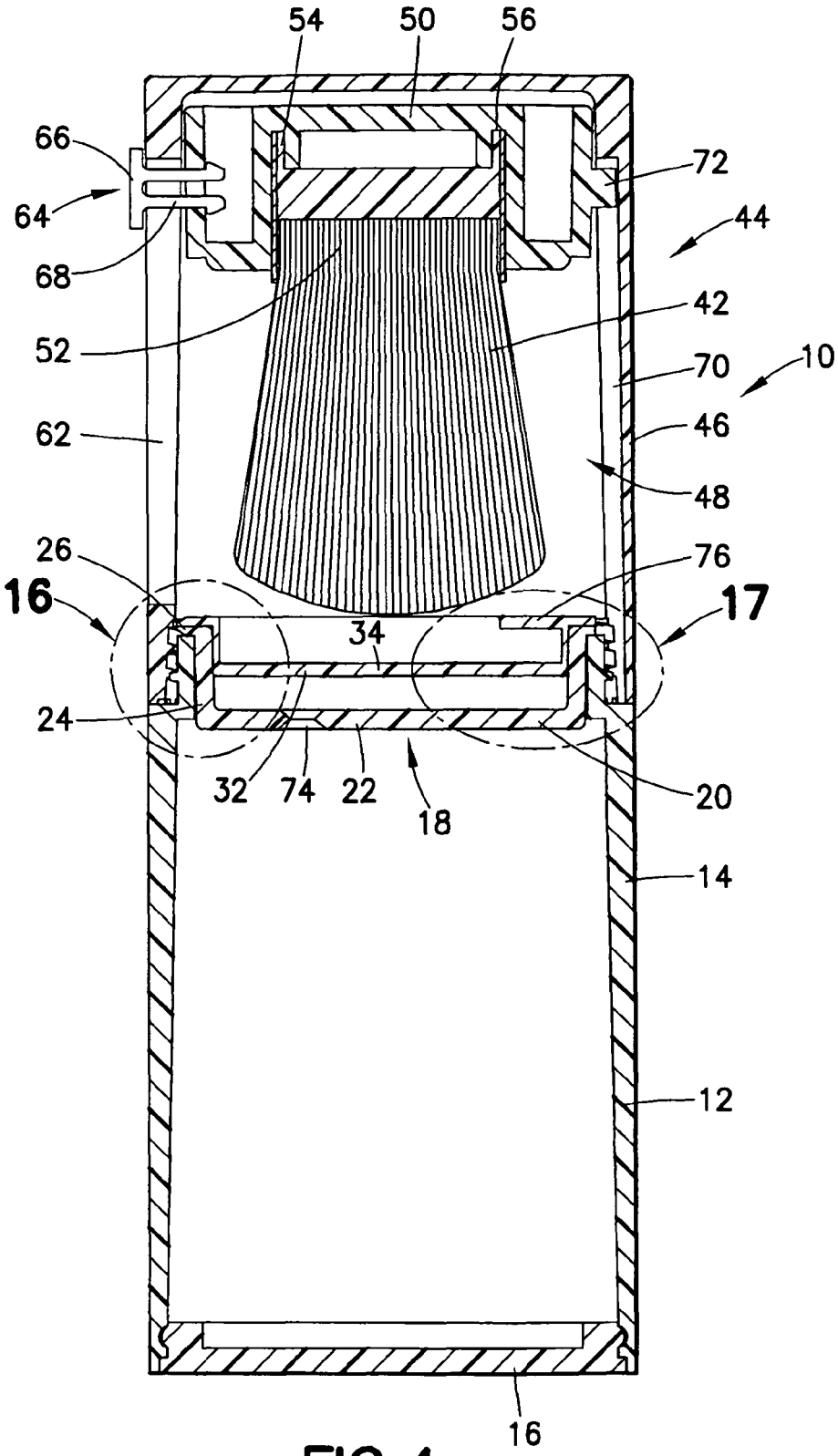
FIG. 4 is a vertical section taken on the line 4-4 of FIG. 1.

Referring first to FIGS. 1 and 4, there is illustrated a cosmetic dispenser of the loose powder variety and generally designated by the numeral 10, for storing and dispensing controlled quantities the product, the dispenser 10 including a container 12 having a side wall 14 and a bottom wall 16 which latter is preferably a closure plug that can be installed as a final step in the manufacturing/assembly process, to be discussed hereinbelow.

Figure 6:
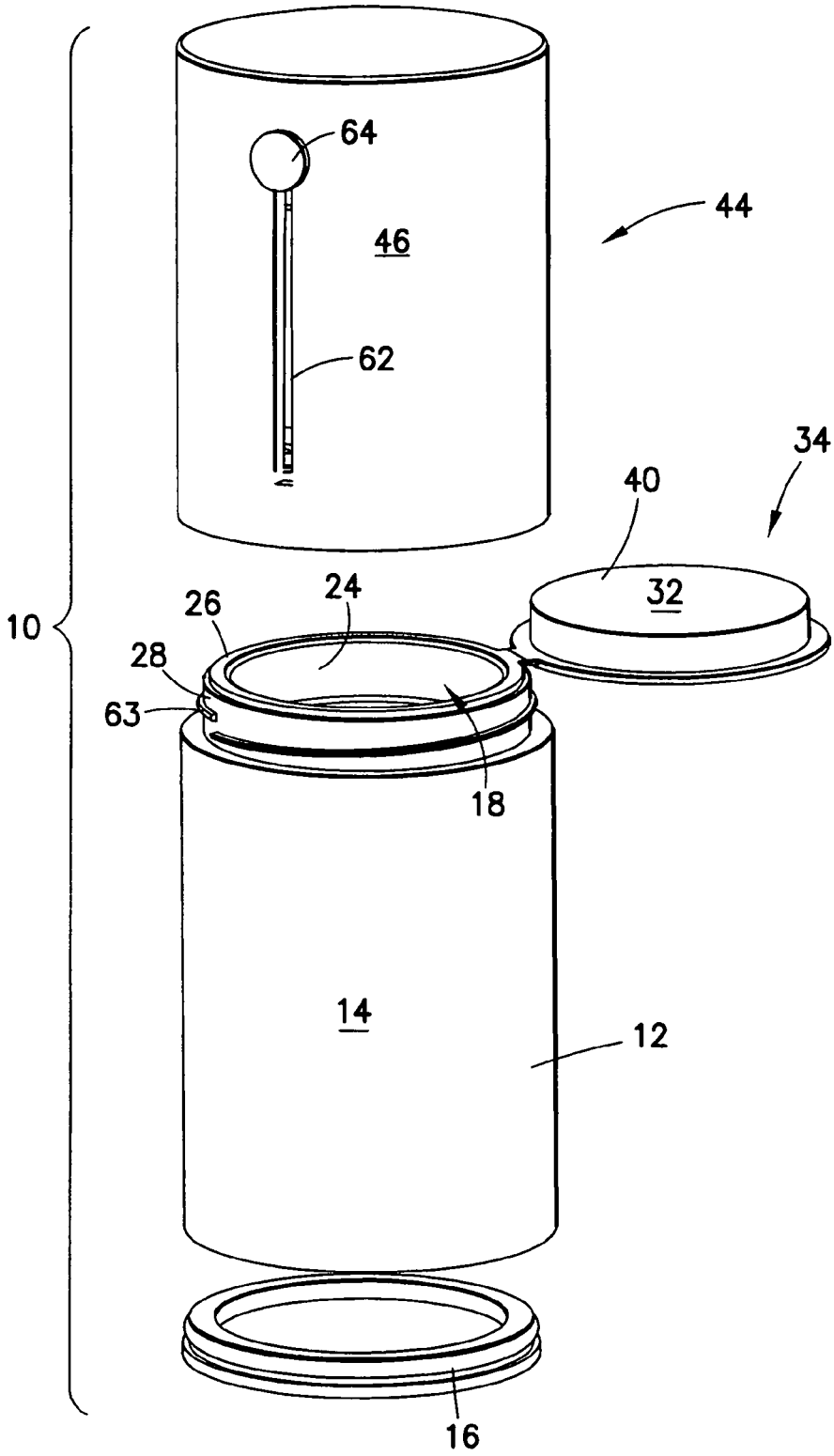
FIG. 6 is an exploded perspective view of the dispenser of FIGS. 1-5, wherein the applicator brush is concealed by virtue of its being disposed in a retracted position inside the closure cap.
Figure 7:
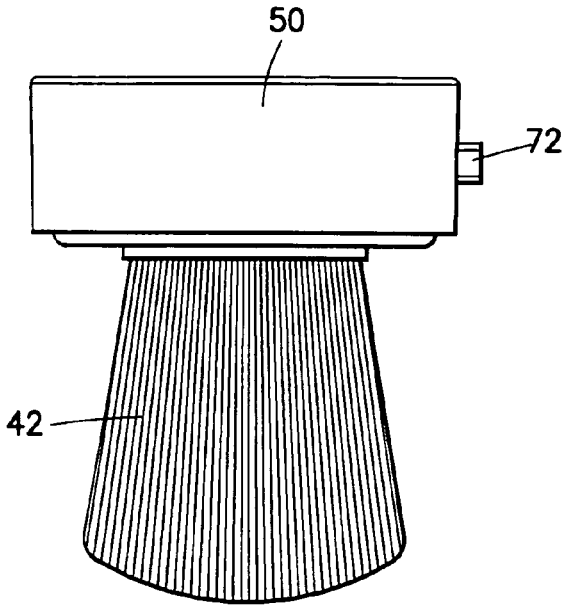
FIG. 7 is a front elevation of the applicator brush of the dispenser, and a slide member which carries the brush in the closure cap.
Figure 8:
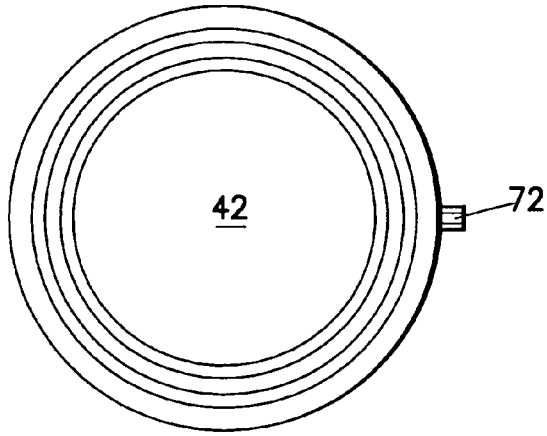
FIG. 8 is a top plan view of the slide member portion of the component of FIG. 7.
Figure 9:
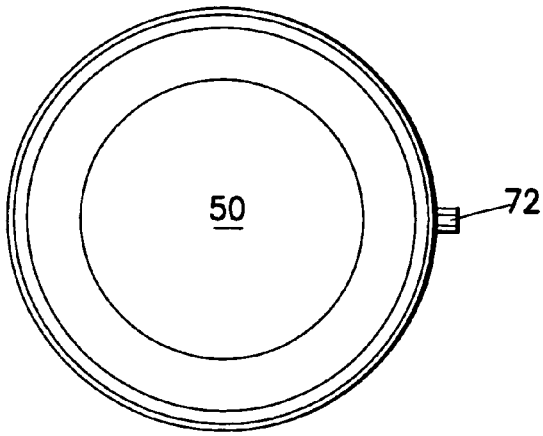
FIG. 9 is a bottom plan view of the brush and slide member of FIGS. 7 and 8.
Figure 11:
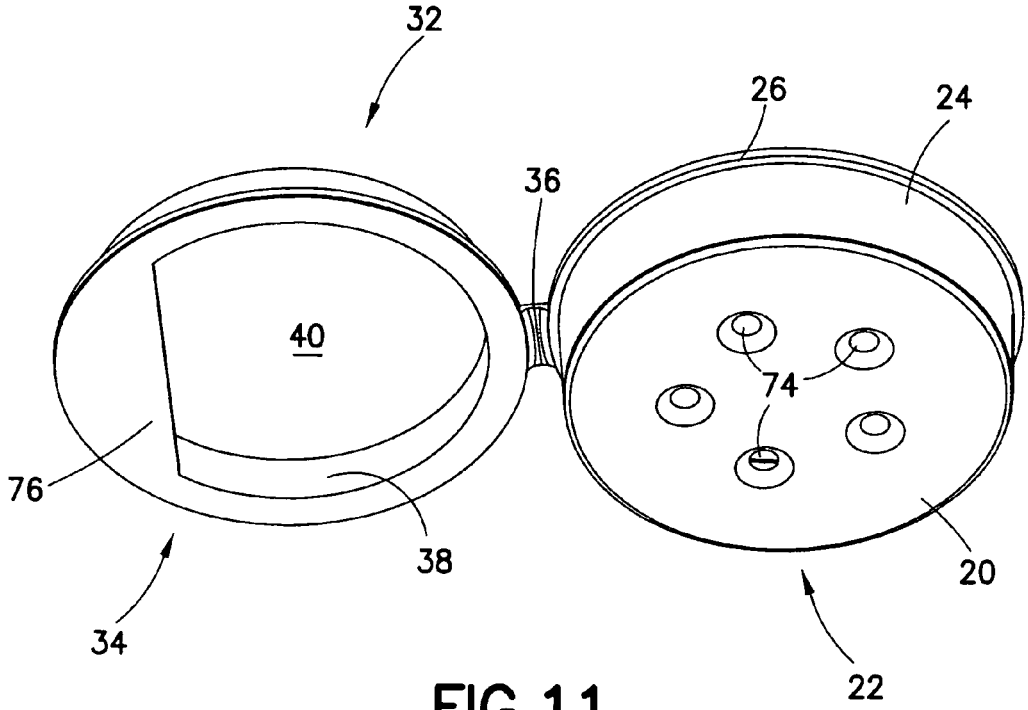
FIG. 11 is a perspective view of a pair of hinged cups that span the mouth of the container of the dispenser, and which are involved with selective opening and closing of the container.
Figure 12:
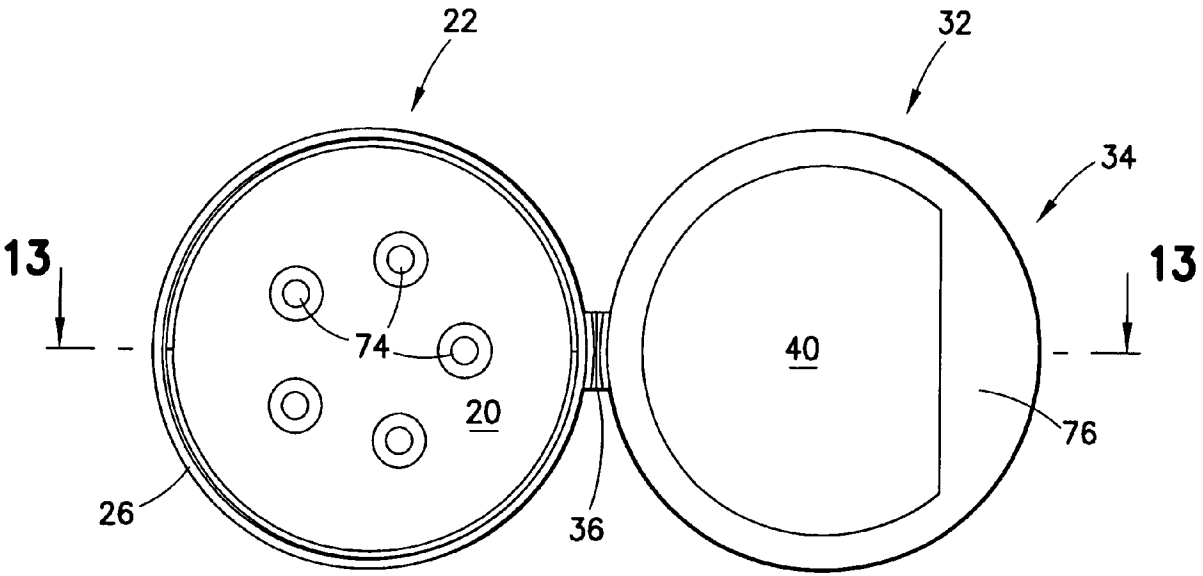
FIG. 12 is a bottom plan view of the hinged cups of FIG. 11.
Figure 13:
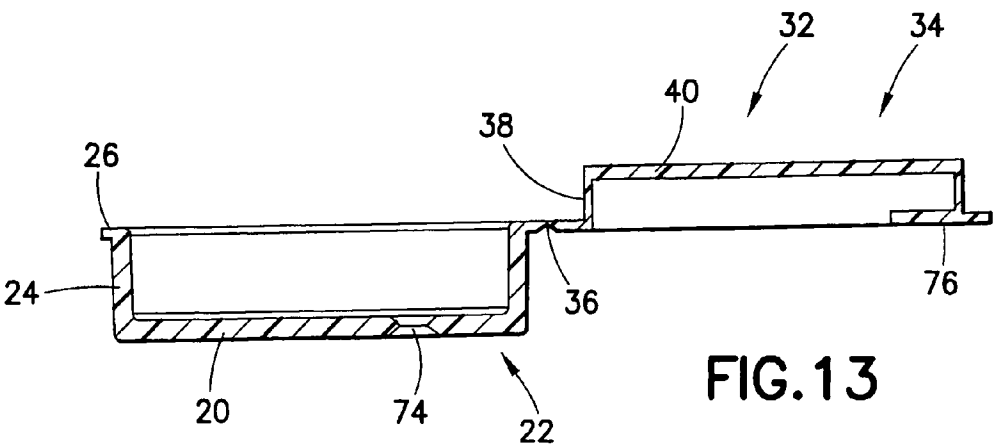
FIG. 13 is a section taken on the line 13-13 of FIG. 12.
Figure 14:
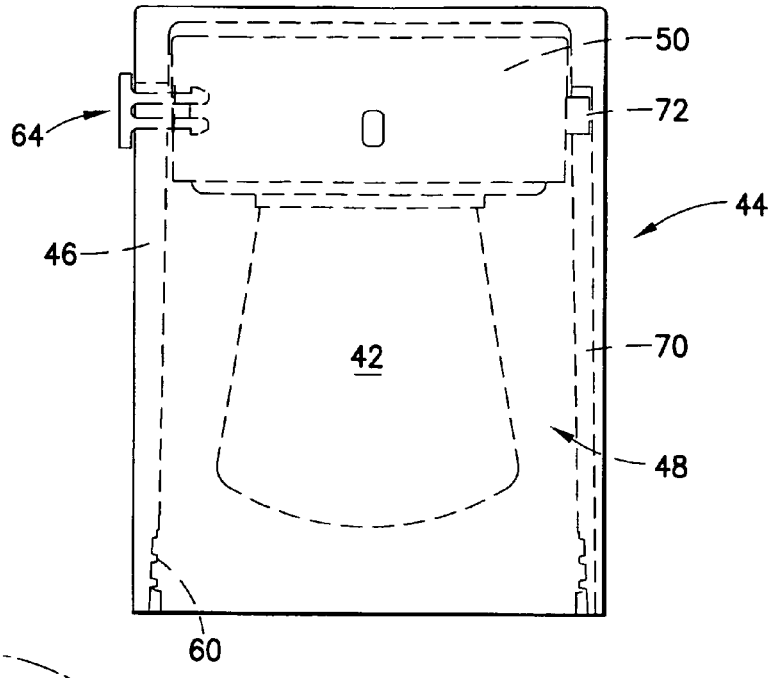
FIG. 14 is a front elevation of the closure cap and applicator brush portions of the dispenser of the invention, with those structures which are normally hidden from view being shown in dotted outline.
Figure 16:
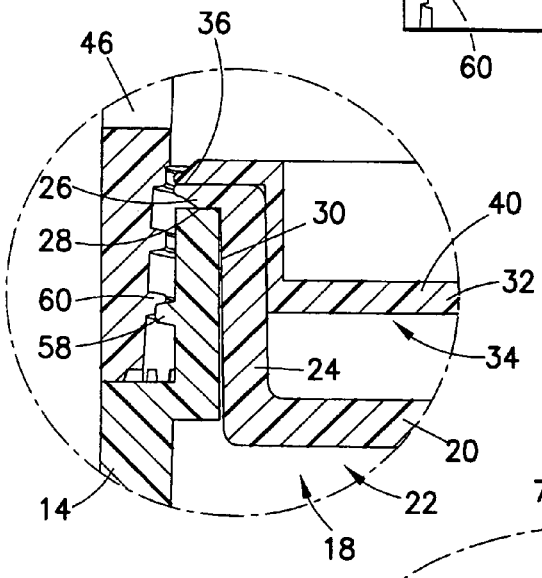
FIG. 16 is a detail view, enlarged, of the dispenser portion indicated in FIG. 4.

In accordance with the present invention or discovery, the container 12 has a mouth 18 which is spanned by an apertured transverse wall 20; the transverse wall 20 is preferably constituted as the bottom wall of a cup 22 having an annular side wall 24 and a radially extending flange 26 at the top of the annular side wall 24. The cup 22 is shown in detail in FIGS. 11, 12 and 13. The flange 26 seats against a ledge 28, FIG. 6, and there exists a press fit between the annular wall 24 and the inner surface 30 of the container 12, FIG. 16. Disposed above the transverse wall 20 and spaced a short distance therefrom is a first cover 32, FIGS. 12 and 13, which closes off both the transverse wall 20 and the container 12 per se. Taken together, the cup 22 and cover 32 constitute a compartment for receiving small quantities of powder through holes in the transverse wall 20, when the cover 32 is in place. The wall 20 can be thought of as a sifter member, for passing small quantities of powder into the compartment. The cover 32 is shown as being constituted as the bottom wall of a second cup 34, the cups 22 and 34 being hingedly connected by a living hinge 36 or equivalent, as particularly illustrated in FIGS. 12 and 13. The cup 34 has a side wall 38 and a solid or imperforate bottom wall 40. The cup 34 is telescopically received in the first cup 22, as shown in FIG. 4, so as to close off the transverse wall 20 from an applicator brush 42 to be described below.

Figure 10:
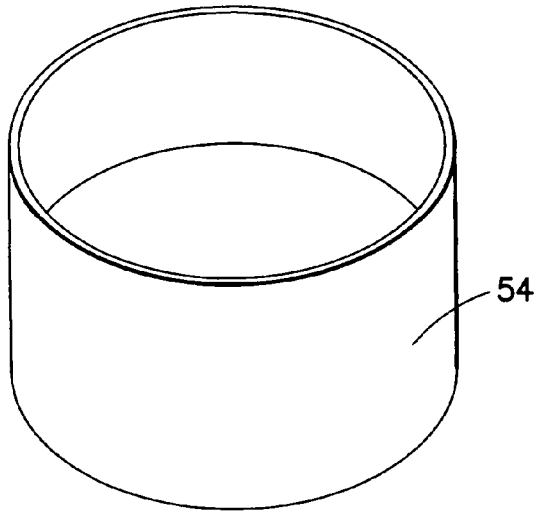
FIG. 10 is a perspective view of a metal ring utilized to bundle together the bristles of the closed end of the applicator brush, and fasten them permanently to the slide member.

Returning to the invention, there is provided, in combination, a further cover or closure cap 44 having a side wall 46, defining an inner compartment 48. The compartment 48 houses the applicator brush 42, which is slidably mounted therein by means of a slide member 50, and arranged for movement therewith, between an advanced position illustrated in FIG. 5, and the retracted position, shown in FIG. 4. The grouped bristles of the closed end of the applicator brush 42 are held together by a metal ring 54, shown in perspective in FIG. 10. The ring 54 can be fastened to the bundled bristles by any suitable manner. Thereafter, the uppermost end of the ring 54 in FIG. 4, fits snugly into a circular groove 56 in the slide member 50 such that the latter and brush bristles form a unitary assemblage, and thus the slide member 50 and applicator brush 42 move as a unit, as noted above.

The side wall 46 of the further cover or closure cap 44 is provided with internal screw threads 60, adapted to mate with cooperable external screw threads 58, 63 on the container 12. The closure cap 44 additionally contains a longitudinal through-slot 62, FIGS. 1, 4 and 6. In conjunction with the slot 62, finger-engageable means 64 are provided at the through-slot 62, in the form of a button 66 and connecting bridge 68, arranged to permit access to the slide member 50 from outside of the closure cap 44. The bridge 68 extends from outside the closure cap 44 to the slide member 50, via the through-slot 62. Also, as shown in FIG. 4, the part of the side wall 46 that is diametrically opposite to the button 66, has a longitudinal inner, blind slot 70, which constitutes a track for a small lug 72 that projects from the slide member 50, FIG. 4.

Figure 17:
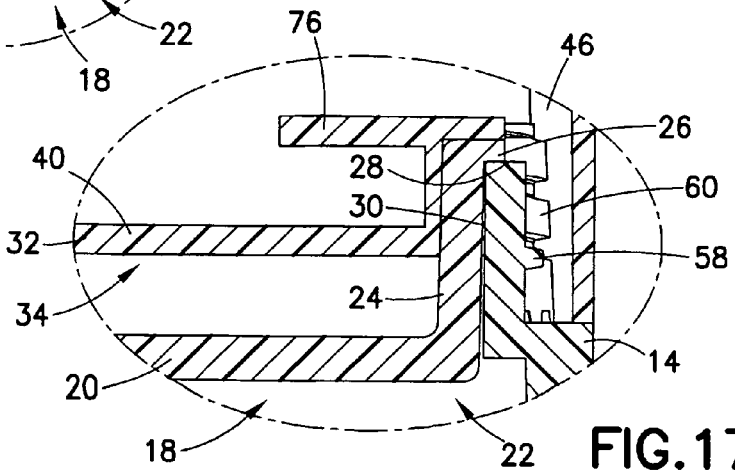
FIG. 17 is a detail view, enlarged, of the dispenser portion indicated in FIG. 4.

Referring again to FIGS. 4, 16 and 17, the invention provides for the dual covers for the container 12, namely second cup 34 and the closure cap 44. In a preferred embodiment and as noted above, the transverse wall 20 which spans the mouth 18 of the container 12 is the bottom of the first cup 22, having the apertures labelled 74 in FIGS. 4, 12 and 13.

Referring again to FIGS. 12, 13, 16 and 17, in place of the living hinge 68, other suitable hinge mechanisms (not shown) could be substituted for that shown.

Opposite the hinge 36 is a finger-engageable lifting edge 76, which enables the user to lift the first cover 32 and gain access to the transverse wall 20, which latter carries a small quantity of powder that adheres thereto, from the container 12. This small accumulation occurs as a consequence of normal jostling of the container 12 when contained in a pocketbook or purse.

Since both the transverse wall 20 and first cover 32 are parts of two cups, the cover 32 can nest in the cup 22 in telescoping fashion. Moreover, the fit between the cup 22 and cover 32 can be made to be sufficiently snug to permit the cover 32 to remain in a closed position overlying the cup 22.

In use, the second cover or closure cap 44 is normally stored on the container 12 as in FIG. 4, when the dispenser 10 is being carried in the pocketbook or purse. The second cup 34 is seated in the first cup 22, and small quantities of powder from the container can migrate through the apertured wall 20, and adhere to the surface just above it. As noted, the adhesion of the powder arises from normal movement of the dispenser 10, or alternately by a deliberate inversion of the unit so as to cause a flow of powder by gravity, to the area between the walls 20 and 40.

Figure 5:
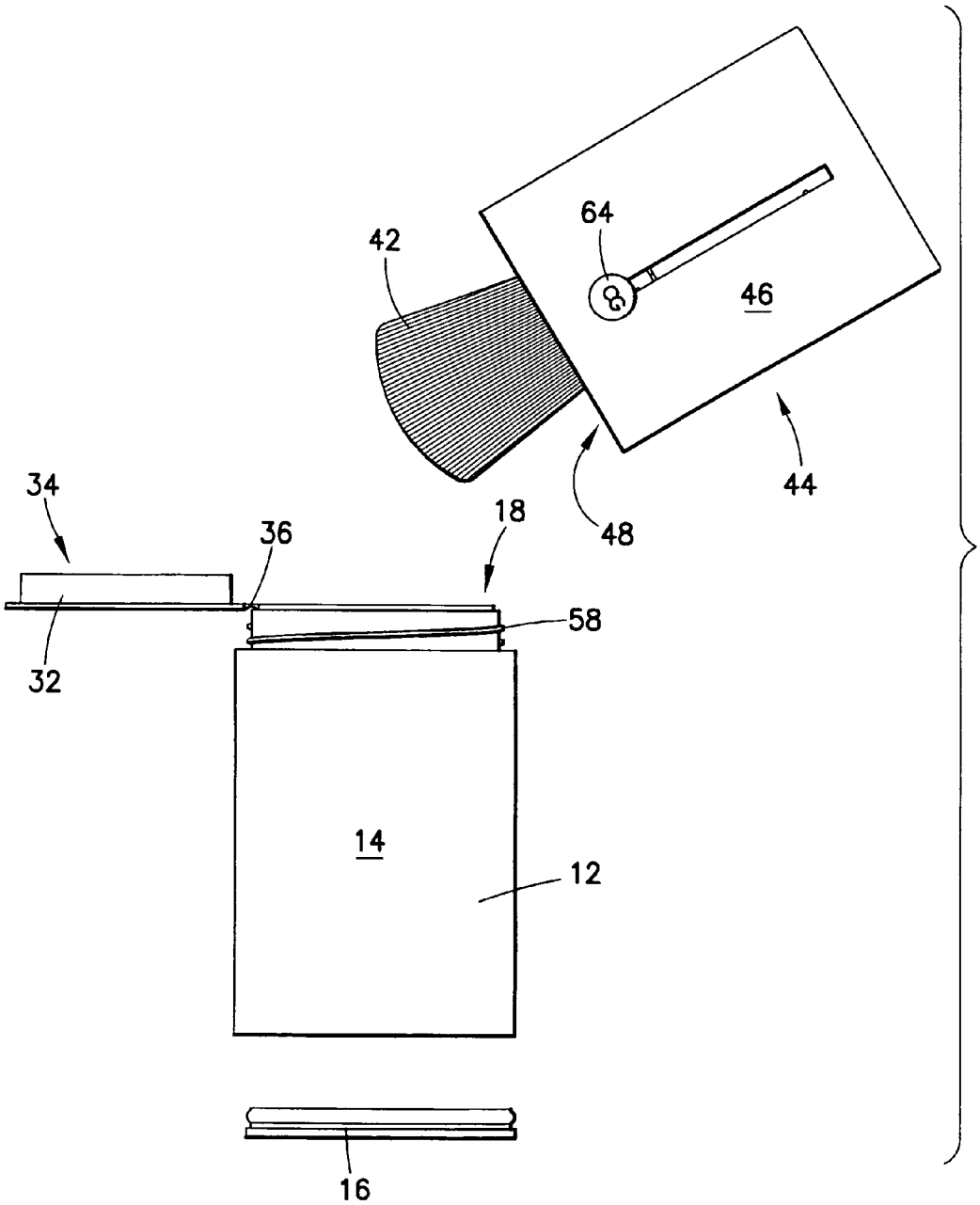
FIG. 5 is a front elevation of the dispenser of FIGS. 1-4, disassembled, illustrating the container and its bottom closure plug, the mouth of the container containing a sifting mechanism, and the closure cap for the container, the closure cap carrying an applicator brush and the brush being disposed in an advanced position with respect to the walls of the closure cap.

When it is desired to use the dispenser, the closure cap 44 is unscrewed from the container 12, and the brush 42 manually shifted to an advanced position in the closure cap 44, as in FIG. 5. The cover 32 is then manually opened. The brush 42 can thus be utilized in this position, as a dabber, to attract a small amount of powder from the opened cup 22 and applied by the user, as desired.

Following completion of the application, the cover 32 is first re-closed, and the brush 42 retracted in the closure cap 44. The latter is then re-applied to the container 12 and screwed in place to the normal storage/shipping position.

Figure 15:
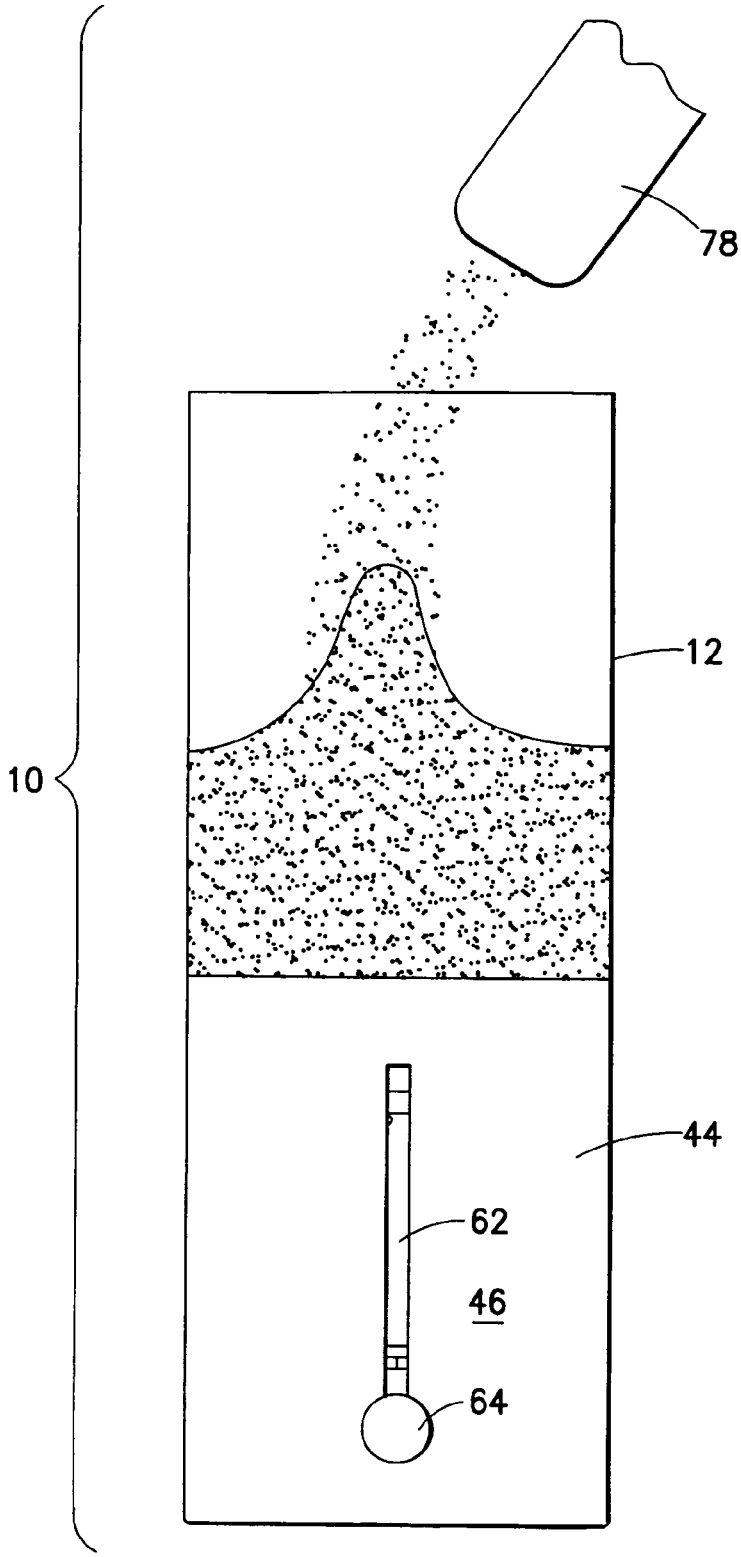
FIG. 15 is a schematic representation of the dispenser, partly in section and partly in elevation, in a mostly assembled state except for a bottom plug that is ultimately secured to the container, and wherein the container is being filled through its (open) bottom from a supply chute containing cosmetic powder.

An important, optional feature of the invention is the provision of the wall or closure plug 16 noted above. During the assembly of the dispenser, cleanliness of the assembly area and lack of powder residues or spillage are important to maintain. With the plug 16 arranged as shown, all but the very last steps can be performed in a powder-free environment. The sequence of last steps, then, involves merely inverting the assembled dispenser, filling the container 12 through its open bottom, and installing the plug 16. Reference is made to FIG. 15, which diagrammatically shows a filling operation. A stream of powder emanates from a chute 78 which is connected to a powder reservoir (not shown). The plug 16 can be secured by cement, sonic weld, or other known methods of fusion.

By such an arrangement, the possibility of cosmetic powder residue filtering into the area around the applicator brush 42 and its slide member 50 is eliminated. The resultant simplification in the fill step is thus seen to constitute a notable manufacturing economy.

From the above it can be seen that I have provided a novel and improved cosmetic dispenser which is physically small, and yet which provides all the necessary features required of a full-service unit.

Additionally, the dispenser of the invention is seen to be eye-catching, and featuring an overall attractive physical appearance when viewed from the outside.

The disclosed arrangement is thus seen to represent a distinct advance and improvement in the cosmetic field.

Each and every one of the appended claims defines an aspect of the invention which is separate and distinct from all others, and accordingly it is intended that each claim be treated as such in any determination of novelty or validity.

Variations and modifications are possible without departing from the spirit of the invention, and portions of the improvement can be used without others.

LIST OF REFERENCE NUMERALS

10 Dispenser
12 Container
14 Side wall
16 Closure plug/bottom wall
18 Mouth of container
20 Transverse wall, sifter member
22 Cup
24 Annular side wall of cup
26 Flange
28 Ledge
30 Inner surface of container
32 First cover
34 Second cup
36 Living hinge
38 Cup side wall
40 Cup bottom wall
42 Applicator brush
44 Closure cap/further cover
46 Side wall
48 Inner compartment
50 Slide member
52 Closed bristles or bristle bunch
54 Metal ring
56 Cylindrical or circular groove
58, 63 External screw threads
60 Internal screw threads
62 Through slot
64 Finger-engageable means
66 Button
68 Connecting bridge
70 Blind slot
72 Lug
74 Apertures or access holes in transverse wall 20
76 Finger-engageable lifting edge
78 Chute The embodiments of the invention in which an exclusive property or privilege is claimed are defined as follows:

1. A dispenser for storing and applying a supply of cosmetic powder, comprising in combination:

a) a container for storage of a quantity of said powder, said container having a mouth, b) a closure cap received by and selectively held captive on the mouth of the container, said closure cap having a side wall defining an inner compartment, c) an applicator brush disposed in said inner compartment, and having brush bristles normally directly facing and being directly adjacent to the mouth of the container when the closure cap is assembled thereto, and cooperable means on said applicator brush and on the side wall of said closure cap, for slidably mounting the brush for advancing and retracting movement with respect to said closure cap when the latter is removed from the mouth of the container, d) flow-regulating means comprising an apertured transverse wall carried by said container and extending across the mouth thereof, e) said flow-regulating means comprising a cover hingedly connected to said apertured transverse wall and overlying the same to normally isolate the applicator brush from the container and the powder disposed therein when the closure cap is received on the mouth of the container, f) said transverse wall and said cover being rendered accessible solely when the closure cap is removed from the container, said cover further being pivotally connected with said transverse wall and capable of being manually shifted from a first, closed position overyling the transverse wall to a second, open position exposing the transverse wall, by means of said hinged connection, whereby in said second, open position the powder contents on the transverse wall are accessible to the applicator brush.

2. The invention as defined in claim 1, wherein:

a) the transverse wall is constituted as the bottom wall of a cup that is pressed fitted into the mouth of the container.

3. The invention as defined in claim 2, wherein:

a) said cup has a lip and the cover comprises a lid for the cup, said lid being hinged to the lip of the cup at one side.

4. The invention as defined in claim 3, wherein:

a) said lid has a finger-engageable lifting edge at one side, to facilitate opening of the same.

5. The invention as defined in claim 4, wherein:

a) the lifting edge of the lid is disposed adjacent to the rim of the container.

6. The invention as defined in claim 3, wherein:

a) the lip of said cup is disposed closely adjacent to the rim of the container.

7. The invention as defined in claim 3, wherein:

a) the hinge of the hinged lip of the cup is disposed adjacent to the rim of the container.

8. The invention as defined in claim 2, wherein:

a) the bottom wall of the cup has multiple holes for limited passage of cosmetic powder therethrough, said bottom wall constituting said apertured transverse wall.

9. The invention as defined in claim 1, wherein:

a) said container has a bottom member comprising a substantially circular plug that is removably secured thereto, to enable an assembled dispenser to be inverted with the plug removed, thereafter the container filled with powder and the plug applied in position, as the final steps in the assembly of the dispenser, b) said sequence of final steps minimizing spillage of powder during the earlier steps in the fabrication of the dispenser.

* * * * *